US010556438B2

(12) United States Patent
Koide

(10) Patent No.: US 10,556,438 B2
(45) Date of Patent: Feb. 11, 2020

(54) LIQUID DISCHARGE HEAD

(71) Applicant: Brother Kogyo Kabushiki Kaisha, Nagoya-shi, Aichi-ken (JP)

(72) Inventor: Shohei Koide, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/215,887

(22) Filed: Dec. 11, 2018

(65) Prior Publication Data

US 2019/0299640 A1 Oct. 3, 2019

(30) Foreign Application Priority Data

Mar. 29, 2018 (JP) ..... 2018/064495

(51) Int. Cl.
*B41J 2/175* (2006.01)
*B41J 2/14* (2006.01)

(52) U.S. Cl.
CPC ..... *B41J 2/17563* (2013.01); *B41J 2/17596* (2013.01); *B41J 2002/14467* (2013.01)

(58) Field of Classification Search
CPC ..... B41J 2/17563; B41J 2/17596; B41J 2002/14467; B41J 2/14233; B41J 2202/12; B41J 2002/14403
See application file for complete search history.

(56) References Cited

U.S. PATENT DOCUMENTS 9,688,076 B2 6/2017 Sugahara et al.
9,950,538 B2 4/2018 Sugahara et al.
2010/0073446 A1* 3/2010 Shimizu ..... B41J 2/14233 347/93
2016/0288499 A1 10/2016 Sugahara et al.
2017/0259579 A1 9/2017 Sugahara et al.

FOREIGN PATENT DOCUMENTS

JP H11-028823 A 2/1999
JP 2016-190431 A 11/2016

* cited by examiner

*Primary Examiner* — Bradley W Thies
(74) *Attorney, Agent, or Firm* — Banner & Witcoff, Ltd.

(57) ABSTRACT

There is provided a liquid discharge head which includes a plurality of individual channels, a common channel which includes a supply portion and a return portion, a first filter in which a plurality of first through holes along a supply direction is formed, and a second filter in which a plurality of second through holes along a discharge direction is formed. An opening at an upstream end in the supply direction of each of the plurality of through holes is smaller than an opening at a downstream end in the supply direction of each of the plurality of first through holes, and an opening at an upstream end in the discharge direction of each of the plurality of second through holes is larger than an opening at a downstream end in the discharge direction of each of the plurality of second through holes.

18 Claims, 9 Drawing Sheets

101
32y
32
20
31
31x
ONE SIDE
PAPER-WIDTH DIRECTION
THE OTHER SIDE
CONVEYANCE DIRECTION 201
32y
232
220
230
233
231
31x
ONE SIDE
PAPER-WIDTH DIRECTION
THE OTHER SIDE
VERTICAL DIRECTION
CONVEYANCE DIRECTION 301
330A
320
23
330
330B
61
62
31x
32y
ONE SIDE
PAPER-WIDTH DIRECTION
THE OTHER SIDE

LIQUID DISCHARGE HEAD

CROSS REFERENCE TO RELATED APPLICATION

The present application claims priority from Japanese Patent Application No. 2018-064495 filed on Mar. 29, 2018, the disclosure of which is incorporated herein by reference in its entirety.

BACKGROUND

Field of the Invention

The present disclosure relates to a liquid discharge head which is equipped with a plurality of individual channels including nozzles respectively.

Description of the Related Art

A liquid discharge head equipped with a plurality of individual channels including nozzles respectively, and a common channel which communicates with the plurality of individual channels has been known. A liquid discharge head which includes a first manifold including a supply portion and a second manifold including a return portion as the common channel has been known. Each of a supply port which is an inlet of the first manifold and a discharge port which is an outlet of the second manifold is provided with a filter. Moreover, in the liquid discharge head, a frequency of foreign particles (such as dust) entering via the discharge port being comparatively lower, for suppressing a channel resistance, a through hole (a second through hole) in the filter (second filter) provided to the discharge port is larger than a through hole (a first through hole) in the filter (first filter) provided to the supply port.

SUMMARY

An object of the present disclosure is to provide a liquid discharge head in which it is possible to realize both an improvement in a filter function and a reduction of the channel resistance.

According to an aspect of the present disclosure, there is provided a liquid discharge head including: a plurality of individual channels including nozzles, respectively; a common channel communicating with the plurality of individual channels and a storage chamber configured to store a liquid, the common channel including: a supply portion arranged between an outlet of the storage chamber and the plurality of individual channels, and a return portion arranged between the plurality of individual channels and an inlet of the storage chamber; a first filter provided to the supply portion, and including a plurality of first through holes each extending in a supply direction in which the liquid passing through the first filter passes in a case that the liquid is supplied from the storage chamber toward the supply portion; and a second filter provided to the return portion, and including a plurality of second through holes each extending in a discharge direction in which the liquid passing through the second filter passes in a case that the liquid is discharged from the return portion toward the storage chamber. An opening at an upstream end of each of the plurality of first through holes in the supply direction is smaller than an opening at a downstream end of each of the plurality of first through holes in the supply direction. An opening at an upstream end of each of the plurality of second through holes in the discharge direction is larger than an opening at a downstream end of each of the plurality of second through holes in the discharge direction.

BRIEF DESCRIPTION OF THE DRAWINGS

FIG. 8A shows a state at a normal time, and FIG. 8B shows a state at the time of reverse flow;

DETAILED DESCRIPTION OF THE EMBODIMENTS

Figure 1:
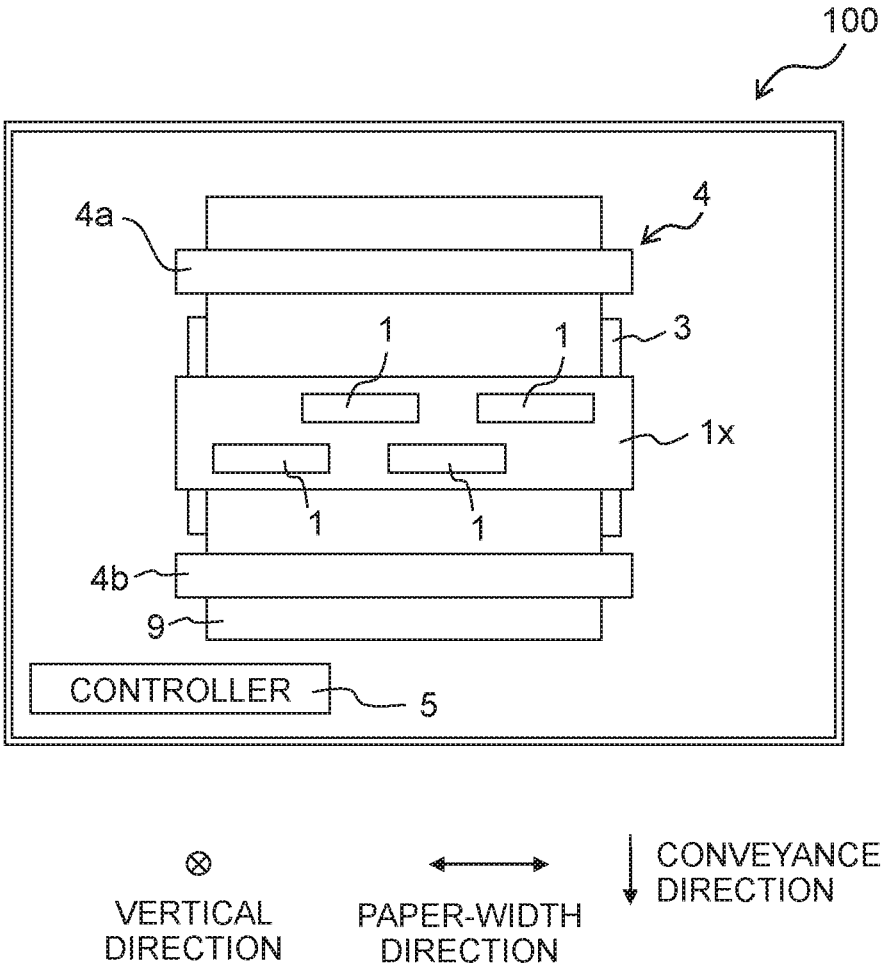
FIG. 1 is a plan view of a printer 100 which is equipped with a head 1.

In the known liquid discharge head, as mentioned above, a correlation between a size of the first through hole and a size of the second through hole has heretofore been known.

In the known liquid discharge head, a flow of liquid is formed such that the liquid is supplied from a storage chamber to the plurality of individual channels via the supply portion, and the liquid is returned from the plurality of individual channels to the storage chamber via the return portion. This is called as a normal time. At the normal time, in the return portion, the foreign particles existing in the plurality of individual channels may be discharged through the second through hole in the second filter. Whereas, sometimes, due to an increase in an amount of the liquid discharged through the nozzles, a pressure of the liquid in the plurality of individual channels drops substantially, and a flow of liquid in a direction reverse of (opposite to) that at the normal time is formed. This is called as a time of reverse flow. At the time of reverse flow, in the return portion, an entry of foreign particles into the plurality of individual channels is prevented by the second filter. In the supply portion, a flow of liquid similar to the flow at the time of reverse flow and the normal time is formed, and an entry of foreign particles into the plurality of individual channels is prevented by the first filter.

The first filter, both at the normal time and at the time of reverse flow, is bent to form a projection in a supply direction due to a pressure of the liquid passing through the filter. Here, the supply direction is a direction in which the liquid passes through the first filter when the liquid is supplied from the storage chamber to the supply portion. Accordingly, an opening at an upstream end in the supply direction of the first through hole becomes smaller than the initial opening and an opening at a downstream end in the supply direction of the first through hole becomes larger than the initial opening. At this time, when the opening at the upstream end in the first through hole is larger than the opening at the downstream end in the first through hole, the opening at the downstream end which is small becomes large. Consequently, since the smallest diameter of the first through hole becomes large, the foreign particles are susceptible to enter into the plurality of individual channels through the first through hole.

The second filter, at the normal time, is bent to form a projection in a discharge direction due to a pressure of liquid passing through the filter. Here, the discharge direction is a direction in which the liquid passes through the second filter when the liquid is discharged from the return portion to the storage chamber. Accordingly, an opening at an upstream end in the discharge direction becomes smaller than the initial opening and an opening at a downstream end in the discharge direction of the second through hole becomes larger than the initial opening. At this time, when the opening at the upstream end in the second through hole is smaller than the opening at the downstream end in the second through hole, the opening at the upstream end which is small becomes further smaller. Consequently, since the smallest diameter of the second through hole becomes small, the foreign particles existing in the plurality of individual channels are hard to be discharged through the second through hole.

The second filter is bent to form a projection in a direction opposite to the discharge direction due to a pressure of the liquid passing through the filter. Accordingly, the opening at the upstream end of the through hole becomes larger than the initial opening and the opening at the downstream end of the through hole becomes smaller than the initial opening. At this time, when the opening at the upstream end in the second through hole is smaller than the opening at the downstream end of the second through hole, the opening at the upstream end which is small becomes large. Consequently, since the smallest diameter of the second through hole becomes large, the foreign particles are susceptible to enter into the plurality of individual channels through the second through hole.

Moreover, in a case in which, the size of the opening on the upstream side and the size of the opening on the downstream side of each of the first through hole and the second through hole are mutually same, when each opening for preventing the entry of the foreign particles is excessively small, the channel resistance may increase. Therefore, in embodiments depicted below, a liquid discharge head which is capable of realizing both an improvement in a filter function and a reduction in the channel resistance will be described.

First Embodiment

Firstly, an overall arrangement of a printer 100 which includes a head 1 according to a first embodiment of the present disclosure will be described below by referring to FIG. 1.

The printer 100 includes a head unit 1*x* that includes four heads 1, a platen 3, a transporting mechanism 4, and a controller 5.

A paper 9 is placed on an upper surface of the platen 3.

Figure 6:
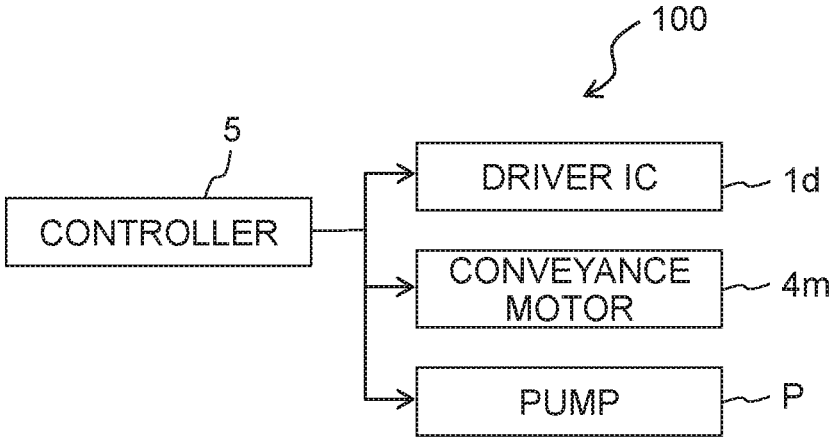
FIG. 6 is a block diagram depicting an electrical configuration of the printer 100.

The transporting mechanism 4 has two pairs of rollers 4*a* and 4*b* arranged to sandwich the platen 3 in a conveyance direction. As a transporting motor 4*m* (refer to FIG. 6) is driven by a control of the controller 5, the pair of rollers 4*a* and 4*b* rotate in a state of pinching the paper 9, and the paper 9 is transported in the conveyance direction.

The head unit 1*x* is a head unit of line type and has a long side in a paper-width direction. The four heads 1 are arranged in a staggered form in the paper-width direction. The head unit of line type is a head unit in which, an ink is discharged onto the paper 9 through nozzles 21 (refer to FIG. 2 and FIG. 3) in a state of a position thereof fixed.

Here, the paper-width direction is orthogonal to the conveyance direction. The paper-width direction and the conveyance direction are both orthogonal to a vertical direction.

The controller 5 has a ROM (Read Only Memory), a RAM (Random Access Memory), and an ASIC (Application Specific Integrated Circuit). The ASIC executes a recording processing in accordance with a computer program stored in the ROM. In the recording processing, the controller 5, on the basis of a recording command (including image data) input from an external equipment such as a PC (personal computer), controls a driver IC 1*d* of each head (refer to FIG. 3 and FIG. 6) and the transporting motor 4*m*, and records an image on the paper 9.

Next, an arrangement of the head 1 will be described below by referring to FIG. 2 to FIG. 5.

The head 1 includes a channel substrate 11, an actuator unit 12, a first filter 61, a second filter 62, and a frame 13.

Figure 3:
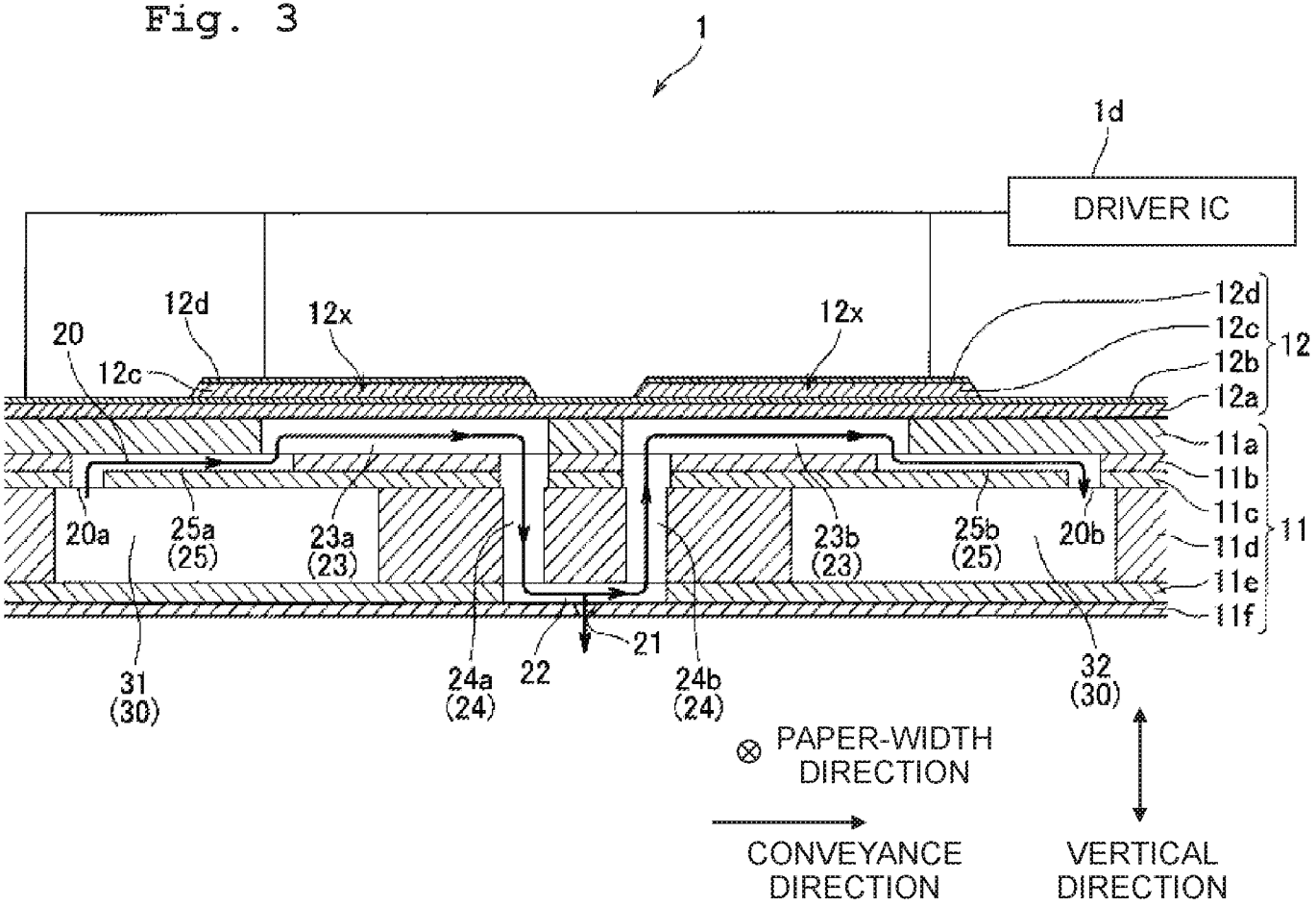
FIG. 3 is a cross-sectional view of the head 1 along a line III-III in FIG. 2.

The channel substrate 11, as depicted in FIG. 3, has six plates 11*a*, 11*b*, 11*c*, 11*d*, 11*e*, and 11*f* (hereinafter, 'plates 11*a* to 11*f*') adhered to one another. A common channel 30 is formed in the plate 11*d*. A plurality of individual channels 20 communicating with the common channel 30 is formed in the plates 11*a* to 11*f*.

Figure 2:
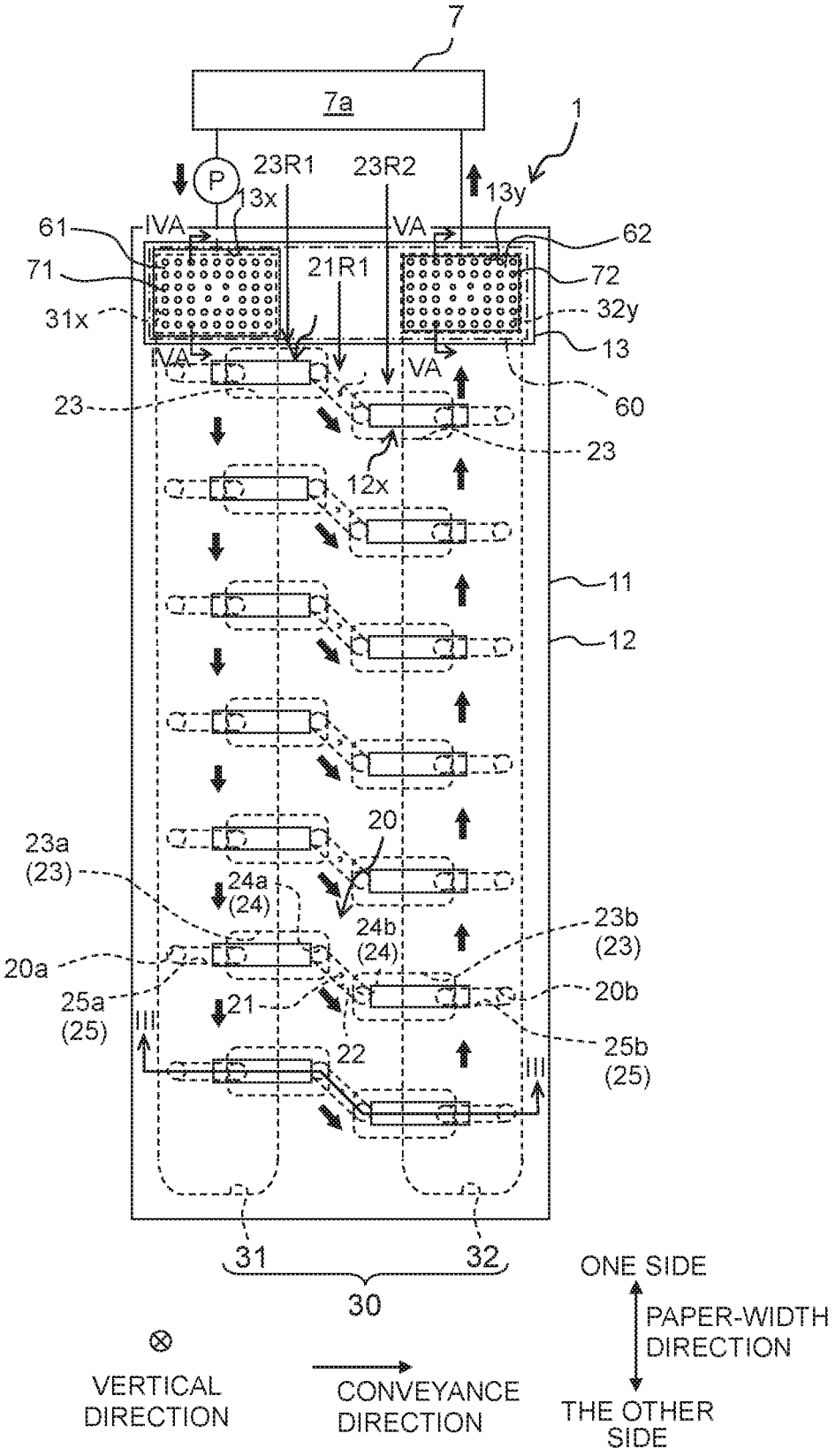
FIG. 2 is a plan view of the head 1.

The common channel 30, as depicted in FIG. 2, includes a supply channel 31 and a return channel 32 arranged in the conveyance direction. The supply channel 31 and the return channel 32 are extended in the paper-width direction. An end portion on one side in the paper-width direction of the supply channel 31 is provided with a supply port 31*x* which is an inlet of the supply channel 31. An end portion on one side in the paper-width direction of the return channels 32 is provided with a discharge port 32*y* which is an outlet of the return channel 32.

Each of the supply port 31*x* and the discharge port 32*y* open on an upper surface of the plate 11*a* (refer to FIG. 3). The supply port 31*x* is arranged between an outlet of the storage chamber 7*a* and the plurality of individual channels 20, and corresponds to the 'supply portion' of the present disclosure. The discharge port 32*y* is arranged between the plurality of individual channels 20 and an inlet of the storage chamber 7*a*, and corresponds to the 'return portion' of the present disclosure.

The supply channel 31 communicates with the storage chamber 7*a* of a sub tank 7 via the supply port 31*x*. The return channel 32 communicates with the storage chamber 7*a* via the discharge port 32*y*. The supply channel 31 is positioned at an upstream of each individual channel 20 and the return channel 32 is positioned at a downstream of each individual channel 20.

The sub tank 7 is mounted on the head 1. The storage chamber 7*a* communicates with a main tank (not depicted in the diagram) which stores the ink, and stores the ink supplied from the main tank. A pump P is provided to a channel which connects the storage chamber 7*a* and the supply port 31*x*. In the description below, the fact that the pump P is provided to the channel which connects the storage chamber 7*a* and the supply port 31*x* is sometimes described as 'the pump P connected to the storage chamber 7*a* and to the supply port 31*x* is provided in the channel' or 'the pump P is provided between the storage chamber 7*a* and the supply port 31*x*'.

Thick arrow marks in FIG. 2 and FIG. 3 indicate a flow of ink.

As depicted in FIG. 2, the ink inside the storage chamber 7*a* is supplied to the supply channel 31 through the supply port 31*x* by the pump P being driven by a control of the controller 5. The ink supplied to the supply channel 31 is supplied to each individual channel 20 while moving through the supply channel 31 from one side in the paper-width direction to the other side in the paper-width direction. The ink supplied to each individual channel 20 flows into the return channel 32, and moves through the return channel 32 from the other side in the paper-width direction to the one side in the paper-width direction. Thereafter, the ink is discharged from the return channel 32 via the discharge port 32*y*, and is returned to the storage chamber 7*a*. By circulating the ink between the storage chamber 7*a* and the plurality of individual channels 20 in such manner, removal of air bubbles in the ink and prevention of thickening of ink are realized.

Each individual channel 20 includes a nozzle 21, a communicating channel 22, two pressure chambers 23, two connecting channels 24, and two joining channels 25. As depicted in FIG. 3, the nozzle 21 is a through hole formed in the plate 11*f*. The communicating channel 22 is a channel passing (running) directly above the nozzle 21, and is a through hole formed in the plate 11*e*. The pressure chamber 23 is a through hole formed in the plate 11*a*. The connecting channel 24 is a through hole formed in the plates 11*b*, 11*c*, and 11*d*, and is extended in the vertical direction. The joining channel 25 is a through hole formed in the plates 11*b* and 11*c*.

The pressure chamber 23, the connecting channel 24, and the joining channel 25 are divided into (classified into) a first pressure chamber 23*a*, a first connecting channel 24*a*, and a first joining channel 25*a*, and a second pressure chamber 23*b*, a second connecting channel 24*b*, and a second joining channel 25*b*. The first pressure chamber 23*a*, the first connecting channel 24*a*, and the first joining channel 25*a*, and the second pressure chamber 23*b*, the second connecting channel 24*b*, and the second joining channel 25*b* sandwich the nozzle 21 in the conveyance direction. The first pressure chamber 23*a*, the first connecting channel 24*a*, and the first joining channel 25*a* are (at positions) between the nozzle 21 and the supply channel 31 in the conveyance direction, or at positions overlapping with the supply channel 31 in the vertical direction. The second pressure chamber 23*b*, the second connecting channel 24*b*, and the second joining channel 25*b* are located at positions between the nozzle 21 and the return channel 32 in the conveyance direction, or at positions overlapping with the return channel 32 in the vertical direction. A portion of the first pressure chamber 23*a* and the first joining channel 25*a* overlap with the supply channel 31 in the vertical direction. A portion of the second pressure chamber 23*b* and the second joining channel 25*b* overlap with the return channel 32 in the vertical direction.

The first pressure chamber 23*a* communicates with the nozzle 21 via the first connecting channel 24*a* and the communicating channel 22. The second pressure chamber 23*b* communicates with the nozzle 21 via the second connecting channel 24*b* and the communicating channel 22. The first pressure chamber 23*a* and the second pressure chamber 23*b* communicate mutually via the first connecting channel 24*a*, the communicating channel 22, and the second connecting channel 24*b*. The first connecting channel 24*a* connects one end of the pressure chamber 23*a*, which is nearer to the nozzle 21 in the conveyance direction and one end of the communicating channel 22, which is nearer to the supply channel 31 in the conveyance direction. The second connecting channel 24*b* connects one end of the second pressure chamber 23*b*, which is nearer to the nozzle 21 in the conveyance direction and the other end in the conveyance direction of the communicating channel 22. The first joining channel 25*a* joins the supply channel 31 and the other end in the conveyance direction of the first pressure chamber 23*a*. The second joining channel 25*b* joins the return channel 32 and the other end in the conveyance direction of the second pressure chamber 23*b*. The nozzle 21 is arranged in the middle of the communicating channel 22 in the conveyance direction.

Each individual channel 20 has an inlet 20*a* connecting with the supply channel 31 and an outlet 20*b* connecting with the return channel 32. The inlet 20*a* corresponds to the end portion of the first joining channel 25*a*, on an opposite side of the first pressure chamber 23*a*. The outlet 20*b* corresponds to the end portion of the second joining channel 25*b*, on an opposite side of the second pressure chamber 23*b*.

Ink supplied to each individual channel 20 moves substantially horizontally from the inlet 20*a* through the first joining channel 25*a* and the first pressure chamber 23*a*, and upon further moving downward through the first connecting channel 24*a*, flows into the communicating channel 22. The ink moves horizontally through the communicating channel 22, and some of the ink is discharged from the nozzle 21, whereas the remaining ink moves upward through the second connecting channel 24*b*, and upon moving horizontally through the second pressure chamber 23*b* and the second joining channel 25*b*, flows into the return channel 32 through the outlet 20*b*.

The plurality of pressure chambers 23 open on an upper surface of the channel substrate 11 (upper surface of the plate 11*a*) as depicted in FIG. 2. The pressure chambers 23 form two pressure chamber rows 23R1 and 23R2. Each of the two pressure chamber rows 23R1 and 23R2 is extended in the paper-width direction and is arranged in the conveyance direction. The pressure chambers 23 in each of the pressure chamber rows 23R1 and 23R2 are arranged at same positions in the conveyance direction, and at an equal interval in the paper-width direction. However, positions of the pressure chambers 23 in the direction of width are shifted (misaligned) in the pressure chamber rows 23R1 and 23R2. Accordingly, for all the pressure chambers 23, positions in the paper-width direction differ for the pressure chambers 23 other than the pressure chambers 23 with the positions shifted (misaligned).

On a lower surface of the channel substrate 11 (a lower surface of the plate 11*f*) the plurality of nozzles 21 is arranged at same positions in the conveyance direction and at an equal interval in the paper-width direction, and form one nozzle row 21R1.

The actuator unit 12 is arranged on the upper surface of the channel substrate 11, and covers the plurality of pressure chambers 23.

The actuator unit 12, as depicted in FIG. 3, includes in order from below, a vibration plate 12*a*, a common electrode 12*b*, a plurality of piezoelectric bodies 12*c*, and a plurality of individual electrodes 12*d*. The vibration plate 12*a* and the common electrode 12*b* are arranged over nearly the entire upper surface of the channel substrate 11, and cover the plurality of pressure chambers 23. Whereas, the piezoelectric body 12*c* and the individual electrode 12*d* are provided for each pressure chamber 23, and are facing the respective pressure chamber 23.

The plurality of individual electrodes 12*d* and the common electrode 12*b* are electrically connected to the driver IC 1*d*, and an electric potential of the common electrode 12*b* is maintained at a ground electric potential whereas an electric potential of the individual electrode 12*d* is to be varied. More specifically, the drive IC 1*d* generates a drive signal on the basis of a control signal from the controller 5, and applies the drive signal to the individual electrode 12*d*. Accordingly, the electric potential of the individual electrode 12*d* varies between a predetermined drive electric potential and the ground electric potential. At this time, a volume of the pressure chamber 23 changes due to a portion of the vibration plate 12*a* and a portion of the piezoelectric body 12 sandwiched between the individual electrode 12*d* and the pressure chamber 23 (an actuator 12*x*) being deformed to form a projection toward the pressure chamber 23. Due to the deformation, a pressure is applied to an ink inside the pressure chamber 23 and the ink is discharged through the nozzle 21.

The actuator unit 12 includes a plurality of actuators 12*x* facing the plurality of pressure chambers 23 respectively. In the present embodiment, for each individual channel 20, by driving the actuators 12*x* facing the two pressure chambers 23 simultaneously, it is possible to increase a flying speed of the ink discharged through the nozzles 21.

Figure 4A:
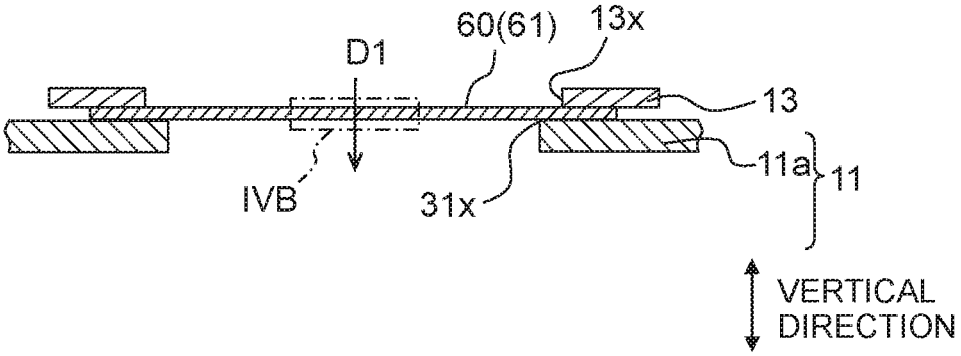
FIG. 4A is a cross-sectional view of an area in proximity of a first filter 61 along a line IVA-IVA in FIG. 2.
Figure 5A:
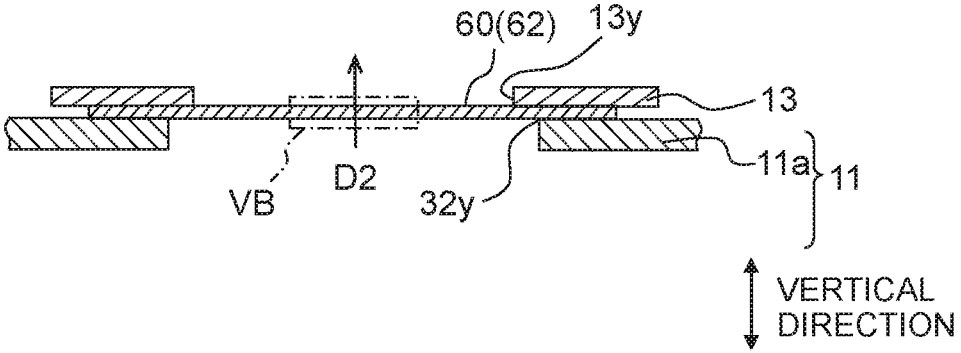
FIG. 5A is a cross-sectional view of an area in proximity of a second filter 62 along a line VA-VA in FIG. 2.

The first filter 61 and the second filter 62, as depicted in FIG. 2, are made of one filter member 60, and are fixed to the channel substrate 11 to cover the supply port 31*x* and the discharge port 32*y* respectively. More specifically, as depicted in FIG. 4A and FIG. 5A, the filter member 60 is arranged on the upper surface of the plate 11*a*, and is pinched by the plate 11*a* and the frame 13. The frame 13 is a rectangular-shaped flat plate having through holes 13*x* and 13*y* in a portion corresponding to the supply port 31*x* and the discharge port 32*y*. An outer edge of each of the first filter 61 and the second filter 62 has a lower surface thereof making a contact with the plate 11*a* and an upper surface thereof making a contact with the frame 13.

The plate 11*a* and the frame 13, as depicted in FIG. 4A, support an outer edge of the first filter 61 from an upstream and a downstream of the supply direction (a direction in which the ink passes through the first filter 61 when the ink is supplied from the storage chamber 7*a* to the supply port 31*x*) D1, and correspond to the 'first supporting member' of the present disclosure. The frame 13 makes a contact with a surface of the outer edge of the first filter 61, which is at upstream of the supply direction D1, and corresponds to the 'first upstream portion' of the present disclosure. The plate 11*a* makes a contact with a surface of the outer edge of the first filter 61, which is at a downstream of the supply direction D1, and corresponds to the 'first downstream portion' of the present disclosure. Here, an amount of the plate 11*a* protruding in a direction from the outer edge of the first filter 61 toward the middle of the first filter 61 is larger (0.1 mm or more than 0.1 mm for example) than an amount of the frame 13 protruding (in a direction from the outer edge of the first filter 61 toward the middle of the first filter 61).

Moreover, the plate 11*a* and the frame 13, as depicted in FIG. 5A, support an outer edge of the second filter 62 from an upstream and a downstream of the discharge direction (a direction in which the ink passes through the second filter 62 when the ink is discharged through the discharge port 32*y* to the storage chamber 7*a*) D2, and correspond to the 'second supporting member' of the present disclosure. The plate 11*a* makes a contact with a surface of the outer edge of the second filter 62, which is at upstream of the discharge direction D2, and corresponds to the 'second upstream portion' of the present disclosure. The frame 13 makes a contact with a surface of the outer edge of the second filter 62, which is at a downstream of the discharge direction D2, and corresponds to the 'second downstream portion' of the present disclosure. Here, an amount of the frame 13 protruding in a direction from the outer edge of the second filter 62 toward the middle of the second filter 62 is larger (0.1 mm or more than 0.1 mm for example) than an amount of the plate 11*a* protruding (in a direction from the outer edge of the second filter 62 toward the middle of the second filter 62).

Figure 4B:
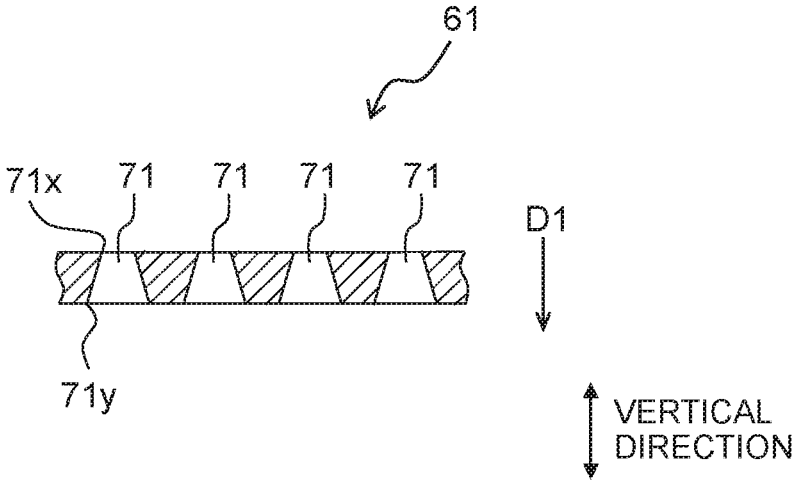
FIG. 4B is an enlarged view of an area IVB in FIG. 4A.
Figure 5B:
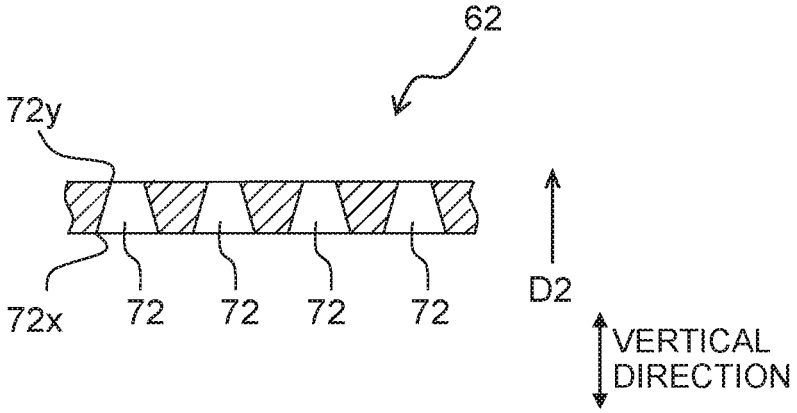
FIG. 5B is an enlarged view of an area VB in FIG. 5A.

A plurality of first through holes 71 along the supply direction D1 is formed in the first filter 61 as depicted in FIG. 4A and FIG. 4B. A plurality of second through holes 72 along the discharge direction D2 is formed in the second filter 62 as depicted in FIG. 5A and FIG. 5B.

The first filter 61 and the second filter 62 are made of the one filter member 60, and a pattern of the plurality of first through holes 71 in the first filter 61 and a pattern of the plurality of second through holes 72 in the second filter 62 are mutually same.

More specifically, in an arrangement in a plan view, as depicted in FIG. 2, both the first through holes 71 and the second through holes 72 are arranged in rows in the paper-width direction and the conveyance direction. Moreover, the nearer the first through holes 71 and the second through holes 72 to the middle of the supply port 31*x* and the discharge port 32*y* respectively, the smaller is the diameter, and are arranged more sparsely. In other words, of the plurality of first through holes 71, the diameter of the first through holes 71 provided on a peripheral edge of the supply port 31*x* (in other words, a peripheral edge of the portion of the first filter 61, facing the supply port 31*x*) is larger than the diameter of the first through holes 71 provided in the middle of the supply port 31*x* (in other words, middle of the portion of the first filter 61, facing the supply port 31*x*). Of the plurality of second through holes 72, the diameter of the second through holes 72 provided on a peripheral edge of the discharge port 32*y* (in other words, a peripheral edge of the portion of the second filter 62, facing the discharge port 32*y*) is larger than the diameter of the second through holes 72 provided in the middle of the discharge portion 32*y* (in other words, middle of the portion of the second filter 62, facing the discharge port 32*y*). Moreover, of the plurality of first through holes 71, the plurality of first through holes 71 provided in the middle of the supply port 31*x* is arranged more sparsely than the plurality of first through holes 71 provided on the peripheral edge of the supply port 31*x*. Of the plurality of second through holes 72, the plurality of second through holes 72 provided in the middle of the discharge port 32*y* is arranged more sparsely than the plurality of second through holes 72 provided on the peripheral edge of the discharge port 32*y*.

For instance, the smallest diameter of the first through holes 71 and the second through holes 72 provided in the center of the supply port 31*x* and the discharge port 32*y* may be 10 μm, and the smallest diameter of the first through holes 71 and the second through holes 72 provided on the peripheral edge of the supply port 31*x* and the discharge port 32*y* may be 12 μm. Moreover, from a point that the first filter 61 and the second filter 62 have a function of preventing the clogging (blocking) of foreign particles (such as dust) in the nozzle 21, the diameter of the first through holes 71 and the diameter of the second through holes 72 may be determined on the basis of a diameter of the nozzle 21 (for example, the diameter of the first through holes 71 and the diameter of the second through holes 72 may be made large in proportion to the diameter of the nozzle 21).

For instance, a density of the first through holes 71 and the second through holes 72 provided in the middle of the supply port 31*x* and the discharge port 32*y* (aperture ratio (ratio of opening) in the middle of the first filter 61 and the second filter 61) may be about 80% of the density of the first through holes 71 and the second through holes 72 provided on the peripheral edge of the supply port 31*x* and the discharge port 32*y*) (aperture ratio (ratio of opening) of the peripheral edge of the first filter 61 and the second filter 62).

The peripheral edge of the portion of each of the first filter 61 and the second filter 62, facing the supply port 31*x* and the discharge port 32*y* is a portion on an inner side of the outer edge of each of the first filter 61 and the second filter 62 (portion pinched between the plate 11*a* and the frame 13). The peripheral edge forms (includes) the channel and the outer edge does not form (include) the channel.

Regarding the cross section, as depicted in FIG. 4B and FIG. 5B, the plurality of first through holes 71 and the plurality of second through holes 72 have a trapezoidal-shaped cross section along the supply direction D1 and the discharge direction D2 respectively, and an opening (aperture) at an upper side of the vertical direction is smaller than an opening (aperture) at a lower side of the vertical direction. In other words, an opening (aperture) 71*x* at an upstream end in the supply direction D1 of each of the plurality of first through holes 71 is smaller than an opening (aperture) 71*y* at a downstream end in the supply direction D1 of each of the plurality of first through holes 71. An opening (aperture) 72*x* at an upstream end in the discharge direction D2 of each of the plurality of second through holes 72 is larger than an opening (aperture) 72*y* at a downstream end in the discharge direction D2 of each of the plurality of second through holes 72.

For instance, a diameter of each of the opening 71*x* and the opening 72*y* may be 12 μm, a diameter of each of the opening 71*y* and the opening 72*x* may be 13 μm, and a base angle of the trapezoidal shape of the cross section may be in the range of 70 degrees to 80 degrees. Depending on a method of manufacturing and a thickness of the member of the first filter 61 and the second filter 62, a difference in the diameter of the openings 71*x* and 72*y* and the diameter of the openings 71*y* and 72*x* may be in the range of 2 μm to 3 μm, and the base angle may be about 70 degrees at least. Smaller the base angle, more susceptible are the first filter 61 and the second filter 62 to bending, and an effect by the present embodiment is achieved optimally.

The filter member 60 is an electroforming filter, and is formed by making a metal such as nickel precipitate on a surface of a mother die on which a plurality of protrusions corresponding to the plurality of first through holes 71 and the plurality of second through holes 72 is formed.

When a flow of ink is such that the ink is supplied from the storage tank 7*a* to the plurality of individual channels 20 via the supply channel 31, and the ink is returned from the plurality of individual channels 20 to the storage chamber 7*a* via the return channel 32 (normal time), at the discharge port 32*y*, foreign particles existing in the plurality of individual channels 20 may be discharged through the second through holes 72 of the second filter 62. Whereas, due to an increase in an amount of the ink discharged from the nozzles 21, when a pressure of the ink inside the plurality of individual channels 20 drops significantly, and a flow of ink in a reverse direction of the flow in the normal case is formed at the discharge port 32*y* (at the time of reverse flow), at the discharge port 32*y*, an entry of the foreign particles into the plurality of individual channels 20 is prevented by the second filter 62. At the supply port 31*x*, a flow of ink similar to the flow at the normal time is formed at the time of reverse flow, the entry of foreign particles into the plurality of individual channels 20 is prevented by the first filter 61.

A state of the first filter 61 and the second filter 62, and the first through holes 71 and the second through holes 72 thereof at the normal time and at the time of reverse flow will be described below by referring to FIG. 7 and FIG. 8.

Figure 7:
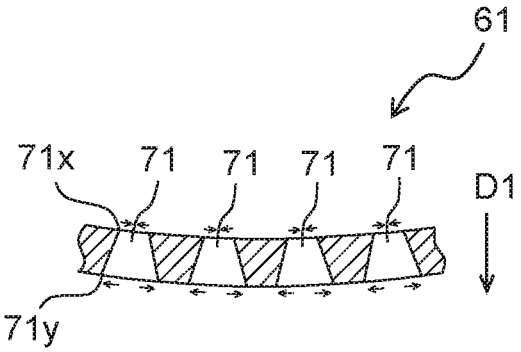
FIG. 7 is a diagram corresponding to FIG. 4B, depicting the first filter 61 in a bend state due to a pressure of ink passing through the first filter 61.

The first filter 61 is bent to form a projection in the supply direction D1 as depicted in FIG. 7 due to a pressure of the ink passing through the first filter 61 both at the normal time and at the time of reverse flow. Accordingly, the opening 71*x* at the upstream end of the first through hole 71 becomes smaller than the initial opening (when the pressure of the ink is not applied to the filter, and the filter is flat), and the opening 71*y* at the downstream end of the first through hole 71 becomes larger than the initial opening.

Figure 8A:
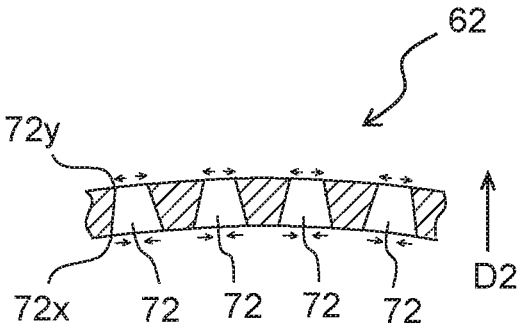
FIG. 8A and FIG. 8B are diagrams corresponding to FIG. 5B, depicting the second filter 62 in a bent state due to a pressure of ink passing through the second filter 62, where.
Figure 8B:
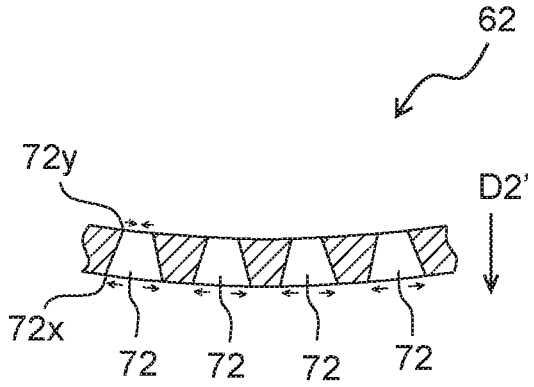

The second filter 62 is bent to form a projection in the discharge direction D2 as depicted in FIG. 8A due to a pressure of the ink passing through the second filter 61, at the normal time. Accordingly, the opening 72*x* at the upstream end of the second through hole becomes smaller than the initial opening, and the opening 72*y* at the downstream end of the second through hole 72 becomes larger than the initial opening.

The second filter 62 is bend to form a projection in a reverse direction D2' which is opposite to the discharge direction D2 as depicted in FIG. 8 due to a pressure of the ink passing through the second filter 62. Accordingly, the opening 72*x* at the upstream end of the second through hole 72 becomes larger than the initial opening, and the opening 72*y* at the downstream end of the second through hole 72 becomes smaller than the initial opening.

The supply direction D1 and the discharge direction D2 are mutually opposite, and the direction D2' and the supply direction D1 are mutually same. Moreover, a change in a size of the openings 71*x*, 71*y*, 72*x*, and 72*y* may be about 1 μm for example.

As mentioned heretofore, according to the present embodiment, the opening 71*x* at the upstream end in the supply direction D1 of the first through hole 71 is smaller than the opening 71*y* at the downstream end in the supply direction D1 of the first through hole 71 (refer to FIG. 4B). Both at the normal time and at the time of reverse flow, as the first filter 61 is bent to form a projection in the supply direction D1, the opening 71*x* at the upstream end which is smaller becomes further smaller (refer to FIG. 7). Consequently, since the minimum diameter of the first through hole 71 becomes small, the foreign particles are hard to enter into the plurality of individual channels 20 through the first through hole 71. Whereas, the opening 72*x* at the upstream end in the discharge direction D2 of the second through hole 72 is larger than the opening 72*y* at the downstream end in the discharge direction D2 of the second through hole 72 (refer to FIG. 5B). At the normal time, as the second filter 62 is bent to form a projection in the discharge direction D2, the opening 72*y* at the downstream end which is smaller becomes larger than the initial opening 72*y* (refer to FIG. 8A). Consequently, since the minimum diameter of the second through hole 72 becomes large, the foreign particles are susceptible to be discharged through the second through hole 72. At the time of reverse flow, the second filter 62 is bent to form a projection in the reverse direction D2' which is opposite to the discharge direction D2, and the opening 72*y* at the downstream end which is smaller becomes further smaller (refer to FIG. 8B). Consequently, since the minimum diameter of the second through hole 72 becomes small, the foreign particles are hard to enter into the plurality of individual channels 20 through the second through hole 72. For each of the first through hole 71 and the second through hole 72, one of the opening at the upstream end and the opening at the downstream end being large, it is possible to lower the channel resistance as compared to a case in which the size of the opening at the upstream end and the size of the opening at the downstream end are mutually same, and each opening is made small.

The first filter 61 and the second filter 62 are made of one filter member 60 (refer to FIG. 2). In this case, it is possible to reduce the number of components as compared to a case in which the first filter 61 and the second filter 62 are made of separate members.

The first filter 61 and the second filter 62 are electroforming filters. Electroforming is a method appropriate for making small-sized components, and is appropriate in a case in which a thin and small filter in particular is sought. Moreover, since a through hole is susceptible to be tapered, for each of the first through hole 71 and the second through hole 72, it is easy to realize an arrangement in which one of the opening at the upstream end and the opening at the downstream end is large.

The first through hole 71 has a trapezoidal-shaped cross-section along the supply direction D1 (refer to FIG. 4B). Moreover, the second through hole 72 has a trapezoidal-shaped cross section along the discharge direction (refer to FIG. 5B). In this case, as compared to a case in which the cross-section has a step, the flow of ink is hard to be inhibited, and it is possible to lower the channel resistance more assuredly.

Of the plurality of first through holes 71, a diameter of the first through holes 71 provided on the peripheral edge of the supply port 31*x* is larger than a diameter of the first through holes 71 provided in the middle of the supply port 31*x*. Of the plurality of second through holes 72, a diameter of the second through holes 72 provided on the peripheral edge of the discharge port 32*y* is larger than a diameter of the second through holes 72 provided in the middle of the discharge port 32*y* (refer to FIG. 2). Ink tends to flow in a large amount to the middle of the supply port 31*x* and the discharge port 32*y*, and tends to be hard to flow to the peripheral edge of the supply port 31*x* and the discharge port 32*y*. With regard to this point, in the present embodiment, by making large the diameter of the first through holes 71 and the diameter of the second through holes 72 provided to the peripheral edge of the supply port 31*x* and the discharge port 32*y*, it is possible to suppress a variation (unevenness) in the flow of ink through the supply port 31*x* and the discharge port 32*y*, and moreover, it is possible to stabilize a function of discharging an ink from the nozzle 21.

Of the plurality of first through holes 71, the plurality of first through holes 71 provided in the middle of the supply port 31*x* are arranged more sparsely than the plurality of first through holes 71 provided on the peripheral edge of the supply port 31*x*. Of the plurality of second through holes 72, the plurality of second through holes 72 provided in the middle of the discharge port 32*y* are arranged more sparsely than the plurality of second through holes 72 provided on the peripheral edge of the discharge port 32*y* (refer to FIG. 2). Ink tends to flow in a large amount to the middle of the supply port 31*x* and the discharge port 32*y*, and tends to be hard to flow to the peripheral edge of the supply port 31*x* and the discharge port 32*y*. Moreover, accordingly, the first filter 61 and the second filter 62 may be damaged by the pressure of the ink flowing through the middle of the supply port 31*x* and the discharge port 32*y*. With regard to this point, in the present embodiment, by the first through holes 71 and the second through holes 72 provided to the middle of the supply port 31*x* and the discharge port 32*y* being arranged sparsely, it is possible to suppress the variation (unevenness) in the flow of ink through the supply port 31*x* and the discharge port 32*y*, and moreover, it is possible to suppress the damage to the first filter 61 and the second filter 62 by the pressure of the ink flowing through the middle of the supply port 31*x* and the discharge port 32*y*.

The outer edge of the first filter 61 is supported by the plate 11*a* and the frame 13 from the upstream and the downstream of the supply direction D1. Here, the amount of the plate 11*a* protruding in the direction from the outer edge of the first filter 61 toward the middle of the first filter 61 is larger than the amount of the frame 13 protruding (in the direction from the outer edge of the first filter 61 toward the middle of the first filter 61) (refer to FIG. 4A). Accordingly, even when the first filter 61 is pressed toward the supply direction D1 by the pressure of the ink passing through the first filter 61 in the normal case, the first filter 61 is supported appropriately by the plate 11*a*, and the first filter 61 is hard to be detached from the frame 31.

The outer edge of the second filter 62 is supported by the plate 11*a* and the frame 13 from the upstream and the downstream of the discharge direction D2. Here, the amount of the frame 13 protruding in the direction from the outer edge of the second filter 62 toward the middle of the second filter 62 is larger than the amount of the plate 11*a* protruding (in the direction from the outer edge of the second filter 62 toward the middle of the second filter 62) (refer to FIG. 5A). Accordingly, even when the second filter is pressed toward the discharge direction D2 by the pressure of the ink passing through the second filter 62 at the normal time, the second filter 62 is supported appropriately by the frame 13, and the second filter 62 is hard to be detached from the frame 13.

The common channel 30 includes the supply channel 31 connected to the inlet 20*a* of the plurality of individual channels 20, and a return channel 32 connected to an outlet 20*b* of the plurality of individual channels 20 (refer to FIG. 2). In this case, by the flow (circulation) of the ink from the storage chamber 7*a* to the supply channel 31, and returning to the storage chamber 7*a* through each individual channel 20 and the return channel 32, it is possible realize resolving thickening of ink and prevention of thickening of ink near the nozzle 21.

The first filter 61 and the second filter 62 are fixed to the channel substrate 11 to cover the supply port 31*x* and the discharge port 32*y* respectively (refer to FIG. 2). In a case of providing the first filter 61 and the second filter 62 inside the channel unit 11 or to a channel (inside a tube etc.) connecting the storage chamber 7*a* and the supply port 31*x* or the discharge port 32*y*, a fixing member for fixing the first filter 61 and the second filter 62 to an interior of the channel unit 11 or to an interior of the tube is necessary, and a job of fixing the first filter 61 and the second filter 62 may become difficult. Whereas, in the present embodiment, it is possible to provide the fixing member to an outer side of the channel substrate 11, and the job of fixing the first filter 61 and the second filter 62 is easy.

The pattern of the plurality of first through holes 71 in the first filter 61 and the pattern of the second through holes 72 in the second filter 62 are mutually same (refer to FIG. 2). In this case, it is possible to form the first through holes 71 and the second through holes 72 of the same mask member, and formation of the first filter 61 and the second filter 62 is easy.

Second Embodiment

Figure 9A:
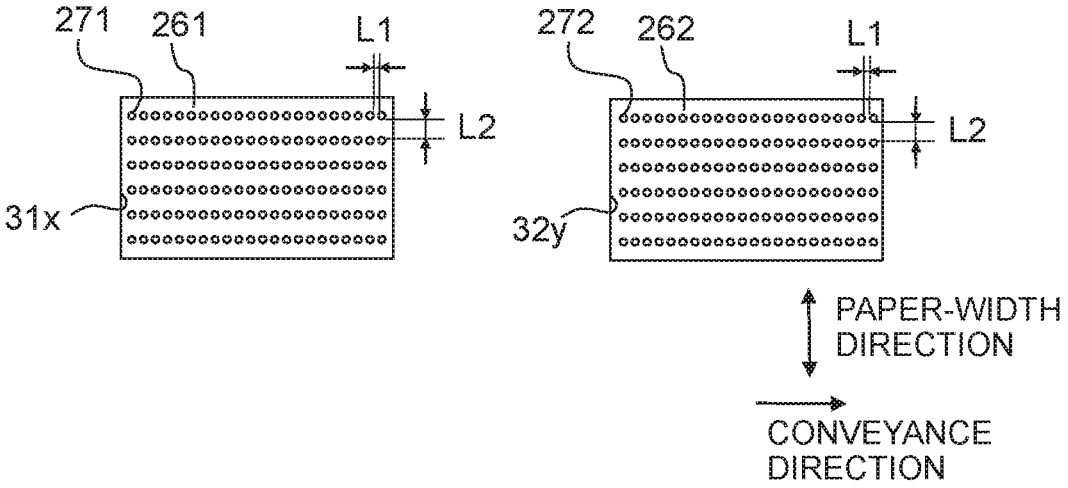
FIG. 9A is a plan view depicting a first filter 261 and a second filter 262.

Next, a head according to a second embodiment of the present disclosure will be described below by referring to FIG. 9A. In the present embodiment, an arrangement of first through holes 271 and second through holes 273 differs from the arrangement of the first through holes 71 and the second through holes 72 in the first embodiment.

Both the first through holes 271 and the second through holes 272, similarly as the first through holes 71 and the second through holes 72 of the first embodiment, are arranged in row along the paper-width direction and the conveyance direction. However, the first through holes 271 and the second through holes 272, unlike the first through holes 71 and the second through holes 72 of the first embodiment, have a uniform diameter. In other words, the plurality of first through holes 271 provided in a first filter 261 have a mutually same diameter, and the plurality of second through holes 272 provided in a second filter 262 have a mutually same diameter. The diameter of the first through hole 271 and the diameter of the second through hole are mutually same.

In the first filter 261 and the second filter 262, the first through holes 271 and the second through holes 272 are arranged in row in the conveyance direction at an interval L1, and are arranged in row in the paper-width direction at an interval L2 (>L1). The interval L1 may be 20 μm and the interval L2 may be 30 μm for example. The intervals L1 and L2 may be determined on the basis of an aspect ratio of the first filter 261 and the second filter 262 (for example, a ratio of the intervals L1 and L2 may be made large in proportion to the aspect ratio).

Here, the conveyance direction is a longitudinal direction of the supply port 31*x* and the discharge port 32*y*. The paper-width direction is a direction of width of the supply port 31*x* and the discharge port 32*y*.

When the supply port 31*x* and the discharge port 32*y* have a long slender shape in the conveyance direction, and the first through holes 271 and the second through holes 272 are arranged uniformly, the first filter 261 and the second filter 262 become susceptible to bending along the conveyance direction (longitudinal direction of the supply port 31*x* and the discharge port 32*y*).

With regard to this point, in the present embodiment, the interval L1 in the conveyance direction for the first through holes 271 and the second through holes 272 is smaller than the interval L2 in the direction of width (direction of width of the supply port 31*x* and the discharge port 32*y*) for the first through holes 271 and the second through holes 272. In other words, the first through holes 271 and the second through holes 272 are arranged more densely in the conveyance direction than in the paper-width direction. Accordingly, stiffness (rigidity) of first filter 261 and the second filter 262 in the conveyance direction becomes lower than the stiffness (rigidity) of the first filter 261 and the second filter 262 in the paper-width direction, and bending along the paper-width direction is susceptible to occur. Consequently, even when the supply port 31*x* and the discharge port 32*y* have a long and slender shape in one direction, it is possible to suppress a variation in bending of the first filter 261 and the second filter 262 in the paper-width direction and the conveyance direction, and moreover, it is possible to suppress a variation in a filter function in the overall first filter 261 and the second filter 262.

Third Embodiment

Figure 9B:
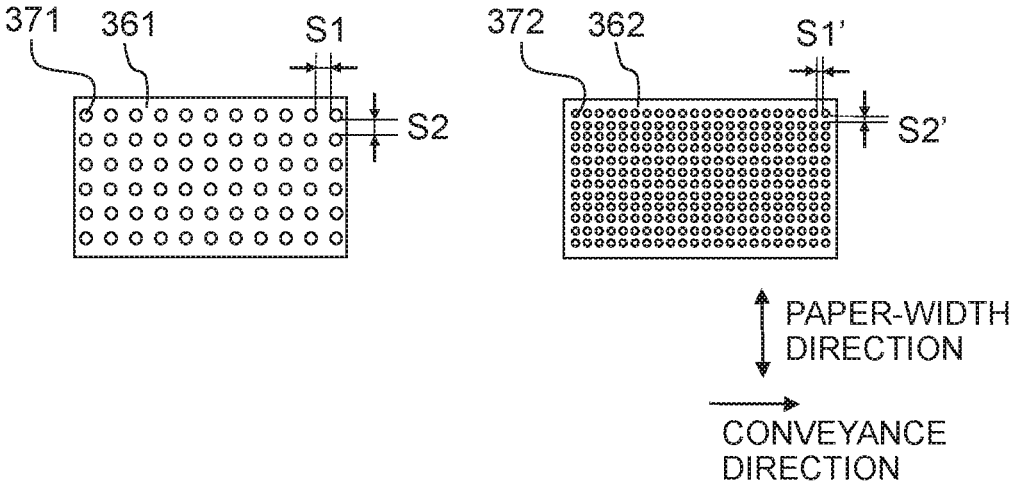
FIG. 9B is a plan view depicting a first filter 361 and a second filter 362.

Next, a head according to a third embodiment of the present disclosure will be described below by referring to FIG. 9B. In the present embodiment, an arrangement of first through holes 371 and second through holes 372 differs from the arrangement of the first through holes 71 and the second through holes 72 in the first embodiment.

Both the first through holes 371 and the second through holes 372, similarly as the first through holes 71 and the second through holes 72 of the first embodiment, are arranged in row along the paper-width direction and the conveyance direction. However, the first through holes 371 and the second through holes 372, unlike the first through holes 71 and the second through holes 72 of the first embodiment, have a uniform diameter. In other words, all of the plurality of first through holes 371 provided in a first filter 361 have a mutually same diameter (10 μm for example), and the plurality of second through holes 372 provided in a second filter 362 have a mutually same diameter (12 μm for example). The diameter of the first through hole 371 is larger than the diameter of the second through hole 372.

In the first filter 361, the first through holes 371 are arranged in row in the conveyance direction at an interval S1, and are arranged in row in the paper-width direction at an interval S2 (=S1). In the second filter 362, the second through holes 372 are arranged in row in the conveyance direction at an interval S1', and are arranged in row in the paper-width direction at an interval S2' (=S1'). The intervals S1' and S2' are smaller than the intervals S1 and S2. In other words, the second through holes 372 are arranged more densely than the first through holes 371. The intervals S1 and S2 may be 30 μm and the intervals S1' and S2' may be 20 μm for example.

Here, even in the present embodiment, similarly as in the first embodiment, the pump P is provided between the storage chamber 7*a* and the supply channel 31 (refer to FIG. 2). In the arrangement, the pattern of the first through holes 371 in the first filter 361 and the pattern of the second through holes 372 in the second filter 362 are mutually same. The first filter 361 being positioned nearer (closer) to the pump P than the second filter 362, has a significant effect of a pressure of the pump P, and is susceptible to be bent substantially by the pressure. In this case, the first filter 361 being bent substantially, an opening at the upstream end of the first through hole 371 becomes even smaller, and the channel resistance becomes high in the first filter 361. Moreover, by the amount of bending becoming comparatively smaller in the second filter 362, an increase in an opening at the downstream end of the second through hole 372 is suppressed, and foreign particles may be hard to be discharged through the second through hole 372. By a difference in the amount of bending occurring between the first filter 361 and the second filter 362, there may be an unevenness in the filter function.

With regard to this point, in the present embodiment, a pattern of the first through holes 371 in the first filter 361 and a pattern of the second through holes 372 in the second filter 362 are not same mutually, and the first through hole 371 has a diameter larger than a diameter of the second through hole 372, and moreover, the second through holes 372 are arranged more densely than the first through holes 371. The larger the diameter of a through hole, the easier it is for the pressure applied to a filter to escape (be released) via the through hole, and the filter is hard to be bent. Moreover, the higher the density of through holes, the lower is the stiffness (rigidity) of the filter, and the filter is susceptible to bending. Consequently, in the present embodiment, the first filter 361 is hard to be bent, and the second filter 362 is susceptible to bending. Therefore, it is possible to suppress a problem of the channel resistance becoming higher in the first filter 361, a problem of the foreign particles becoming hard to be discharged through the second through holes 372 of the second filter 362, and a problem of the unevenness occurring in the filter function of the first filter 361 and the second filter 362.

A difference in the diameter of the first through hole 371 and the diameter of the second through hole 372 may be determined by a difference in a pressure applied to the first filter 361 and a pressure applied to the second filter 362.

Modified Embodiments

Although the preferred embodiments of the present disclosure are described heretofore, the present disclosure is not restricted to the abovementioned embodiments, and various modifications within the scope of the patent claim are possible.

Figure 9C:
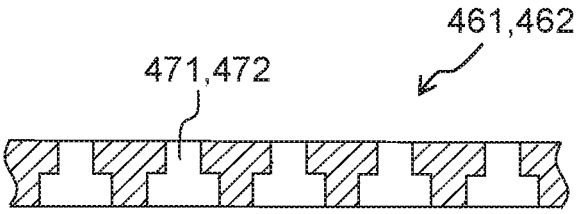
FIG. 9C is a diagram corresponding to FIG. 4B and FIG. 5B, depicting filters 461 and 462.

The shape of the cross section of the first through hole and the second through hole is not restricted to the trapezoidal shape. For instance, in a modified embodiment in FIG. 9C, a cross-sectional shape of through holes 471 and 472 of filters 461 and 462 is a protrusion shape provided with a step (stage).

The pattern of the first through holes and the pattern of the second through holes are modifiable arbitrarily. For instance, the first through holes and the second through holes may be arranged randomly without forming rows. Moreover, the pattern of the first through holes and the pattern of the second through holes may not be same mutually (refer to the third embodiment).

A position and a size of each of the supply port and the discharge port are not restricted in particular. For instance, in the abovementioned embodiments, one end-portion in the paper-width direction of the supply channel 31 and the return channel 32 are provided with the supply port 31*x* and the discharge port 32*y* respectively, and the supply port 31*x* and the discharge port 32*y* are arranged (side-by-side) in the conveyance direction. However, an arrangement is not restricted to such arrangement. In a head 101 according to a first modified embodiment of FIG. 10A, the supply port 31*x* is provided to the other end-portion in the paper-width direction of the supply channel 31. The discharge port 32*y* is provided to one end-portion in the paper-width direction of the return channel 32. The supply port 31*x* and the discharge port 32*y* are not arranged side-by-side in the conveyance direction. Moreover, in this modified embodiment, a flow of ink in the supply channel 31 differs from the flow of ink in the supply channel 31 in the abovementioned embodiments, and ink supplied to the supply channel 31 is supplied to each individual channel 20 while moving through the supply channel 31 from the other side in the paper-width direction to the one side in the paper-width direction.

The common channel is not restricted to include the supply channel and the return channel.

Figures 10A, 10B, 10C:
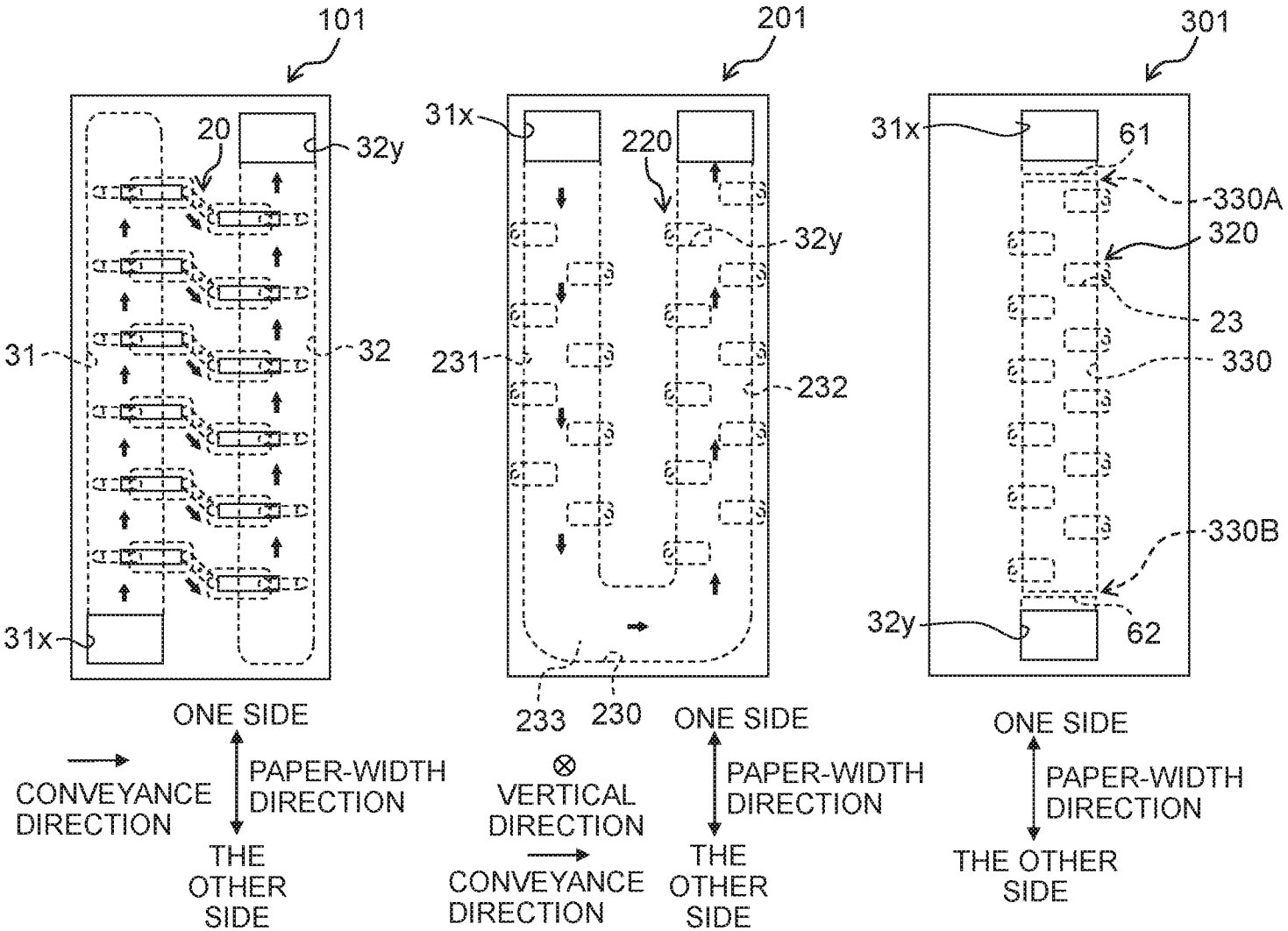
FIG. 10A is a plan view of a head 101.
FIG. 10B is a plan view of a head 201.
FIG. 10C is a plan view of a head 301.

For instance, a head 201 according to a second modified embodiment of FIG. 10B includes one common channel 230. The common channel 230 is U-shaped when viewed from the vertical direction, and includes a first portion 231 and a second portion 232, each extended in the paper-width direction, and a third portion 233 extended in the conveyance direction to connect the first portion 231 and the second portion 232. One end-portion in the direction of width of the first portion 231 is provided with the supply port 31*x*. One end-portion in the direction of width of the second portion 232 is provided with the discharge port 32*y*.

A head 301 according to a third modified embodiment of FIG. 10C includes one common channel 330. The common channel 330 is extended in the paper-width direction, and one end-portion in the direction of width thereof is provided with the supply port 31*x* and the other end-portion in the direction of width thereof is provided with the discharge port 32*y*. The common channel 330 includes a supply portion 330A (a portion positioned at an upstream of a plurality of individual channels 320) and a return portion 330B (a portion positioned at a downstream of the plurality of individual channels 320). In the third modified example, the first filter 61 and the second filter 62 are provided to the supply portion 330A and the return portion 330B, and not to the supply port 30*x* and the discharge port 32*y*.

The 'supply portion' and the 'return portion' of the present disclosure are not restricted to the supply port and the discharge port which are end portions of the common channel. For instance, the 'supply portion' and the 'return portion' of the present disclosure may be at an interior of the common channel (refer to FIG. 10C). Furthermore, the 'supply portion' and the 'return portion' of the present disclosure are not restricted to be provided to the channel substrate, and may be provided between the storage chamber and the channel substrate (for example, inside a tube which is a channel connecting the storage chamber 7*a* and the supply port 31*x* or the discharge port 32*y*).

The number of pressure chambers in the individual channel is two in the abovementioned embodiments. However, the number of pressure chambers may be three or more than three. For instance, in FIG. 10B and FIG. 10C, the individual channels 220 and 320 include one pressure chamber 23.

The first filter and the second filter may be made of separate members and not one filter member.

The first filter and the second filter are not restricted to electroforming filters, and may be manufactured by an arbitrary method of manufacturing (such as etching).

The pump, in the abovementioned embodiments, is provided between the storage chamber and the supply portion. However, without restricting to such arrangement, the pump may be provided between an outlet of the storage chamber and the supply portion and between the return portion and an inlet of the storage chamber.

The actuator is not restricted to an actuator of a piezo (electric) type in which a piezoelectric element is used, and may be an actuator of other type (such as a thermal type is which a heating element is used and an electrostatic type in which an electrostatic force is used).

The head is not restricted to be of a line type, and may be of a serial type (a type in which a liquid is discharged from nozzles onto an object of discharging while moving in a scanning direction which is parallel to the paper-width direction).

The object of discharging is not restricted to paper, and may be an object such as a cloth and a substrate.

The liquid to be discharged from the nozzle is not restricted to ink, and may be an arbitrary liquid (such as a process liquid (treatment liquid) which agglutinates or precipitates constituents in ink).

The present disclosure is not restricted to printers, and is also applicable to a facsimile, a copy machine, and a multifunction device. Moreover, the present disclosure is also applicable to a liquid discharge apparatus which is used for an application other than recording of image (such as a liquid discharge apparatus which forms an electroconductive pattern by discharging an electroconductive liquid onto a substrate).

What is claimed is:

1. A liquid discharge head, comprising:

a plurality of individual channels including nozzles, respectively;

a common channel communicating with the plurality of individual channels and a storage chamber configured to store a liquid, the common channel including: a supply portion arranged between an outlet of the storage chamber and the plurality of individual channels, and a return portion arranged between the plurality of individual channels and an inlet of the storage chamber;

a first filter provided to the supply portion, and including a plurality of first through holes each extending in a supply direction in which the liquid passing through the first filter passes in a case that the liquid is supplied from the storage chamber toward the supply portion; and a second filter provided to the return portion, and including a plurality of second through holes each extending in a discharge direction in which the liquid passing through the second filter passes in a case that the liquid is discharged from the return portion toward the storage chamber, wherein an opening at an upstream end of each of the plurality of first through holes in the supply direction is smaller than an opening at a downstream end of each of the plurality of first through holes in the supply direction, and wherein an opening at an upstream end of each of the plurality of second through holes in the discharge direction is larger than an opening at a downstream end of each of the plurality of second through holes in the discharge direction.

2. The liquid discharge head according to claim 1, wherein the first filter includes a filter member and the second filter includes the filter member.

3. The liquid discharge head according to claim 1, wherein each of the first filter and the second filter is an electroforming filter.

4. The liquid discharge head according to claim 1, wherein a cross section of each of the plurality of first through holes in the supply direction has a trapezoidal shape.

5. The liquid discharge head according to claim 1, wherein a cross section of each of the plurality of second through holes in the discharge direction has a trapezoidal shape.

6. The liquid discharge head according to claim 1, wherein a diameter of a certain first through hole, among the plurality of the first through holes, positioned at a peripheral edge of the supply portion, is larger than a diameter of another first through hole, among the plurality of the first through holes, positioned at a middle of the supply portion.

7. The liquid discharge head according to claim 1, wherein a diameter of a certain second through hole, among the plurality of second through holes, positioned at a peripheral edge of the return portion, is larger than a diameter of another second through hole, among the plurality of second through holes, positioned at a middle of the return portion.

8. The liquid discharge head according to claim 1, wherein a part of the plurality of first through holes positioned at the middle of the supply portion, is arranged more sparsely than another part of the plurality of first through holes positioned at a peripheral edge of the supply portion.

9. The liquid discharge head according to claim 1, wherein a part of the plurality of second through holes positioned in the middle of the return portion, is arranged more sparsely than another part of the plurality of second through holes positioned at a peripheral edge of the supply portion.

10. The liquid discharge head according to claim 1, wherein the plurality of first through holes is arranged in a row in a longitudinal direction of the supply portion and in a width direction of the supply portion, and wherein an interval of the plurality of first through holes in the longitudinal direction of the supply portion is smaller than an interval of the plurality of first through holes in the width direction of the supply portion.

11. The liquid discharge head according to claim 1, wherein the plurality of second through holes is arranged in a row in a longitudinal direction of the return portion and in a width direction of the return portion, and wherein an interval of the plurality of second through holes in the longitudinal direction of the return portion is smaller than an interval of the plurality of second through holes in the width direction of the return portion.

12. The liquid discharge head according to claim 1, further comprising:

a first supporting member supporting an outer edge of the first filter from an upstream of the supply direction and from a downstream of the supply direction, wherein the first supporting member includes a first upstream portion contacting with a surface, of the outer edge of the first filter, in the upstream of the supply direction, and a first downstream portion contacting with a surface, of the outer edge of the first filter, in the downstream of the supply direction, and wherein an amount of the first downstream portion protruding from the outer edge of the first filter toward a middle of the first filter is larger than an amount of the first upstream portion protruding from the outer edge of the first filter toward the middle of the first filter.

13. The liquid discharge head according to claim 1, further comprising:

a second supporting member supporting an outer edge of the second filter from an upstream of the discharge direction and from a downstream of the discharge direction, wherein the second supporting member includes a second upstream portion contacting with a surface, of the outer edge of the second filter, in the upstream of the discharge direction, and a second downstream portion contacting with a surface, of the outer edge of the second filter, in the downstream of the discharge direction, and wherein an amount of the second downstream portion protruding from the outer edge of the second filter toward a middle of the second filter is larger than an amount of second upstream portion protruding from the outer edge of the second filter toward the middle of the second filter.

14. The liquid discharge head according to claim 1, wherein the common channel includes: a supply channel including the supply portion, and connected to an inlet of the plurality of individual channels; and a return channel including the return portion, and connected to an outlet of the plurality of individual channels.

15. The liquid discharge head according to claim 1, further comprising:

a channel substrate including: the plurality of individual channels; the common channel; a supply port which is an inlet of the common channel; and a discharge port which is an outlet of the common channel, wherein the first filter is fixed to the channel substrate to cover the supply port which is the supply portion, and wherein the second filter is fixed to the channel substrate to cover the discharge port which is the return portion.

16. The liquid discharge head according to claim 1, wherein a pattern of the plurality of first through holes in the first filter is same as a pattern of the plurality of second through holes in the second filter.

17. The liquid discharge head according to claim 1, further comprising:

a pump connected to the storage chamber and the supply portion, wherein a diameter of the plurality of first through holes is larger than a diameter of the plurality of second through holes.

18. The liquid discharge head according to claim 1, further comprising a pump connected to the storage chamber and the supply portion, wherein the plurality of second through holes is arranged more densely than the plurality of first through holes.

* * * * *